United States Patent [19]

Egli

[11] Patent Number: 4,592,285

[45] Date of Patent: Jun. 3, 1986

[54] DRAWING TABLE

[76] Inventor: Gordon J. Egli, 506 Pendray St., Victoria, British Columbia, Canada, V8V 2A2

[21] Appl. No.: 538,963

[22] Filed: Oct. 4, 1983

[51] Int. Cl.[4] ..... A47F 5/12; A47G 1/24; G09F 13/04; F21V 17/02

[52] U.S. Cl. ..... 108/9; 108/23; 248/455; 362/97; 362/320

[58] Field of Search ..... 108/9, 6, 23, 1; 297/DIG. 6, 377; 362/98, 97, 99, 320, 278; 312/231; 248/205.2, 455, 454; 40/361, 564, 574, 582, 571

[56] References Cited

U.S. PATENT DOCUMENTS

| | | | |
|---|---|---|---|
| 472,099 | 4/1892 | Wyns | 108/23 |
| 2,205,860 | 6/1940 | Olds | 362/320 |
| 2,328,471 | 8/1943 | Leffel | 108/9 |
| 2,918,682 | 12/1959 | Thoresen et al. | 297/377 |
| 3,019,331 | 1/1962 | Geist | 262/97 |
| 3,839,632 | 10/1974 | Federico | 362/278 |
| 3,908,830 | 9/1975 | Skrzelowski | 248/205.2 |
| 4,061,422 | 12/1977 | Geurts et al. | 362/320 |
| 4,467,727 | 8/1984 | Strommer | 108/9 |

*Primary Examiner*—William E. Lyddane

*Assistant Examiner*—Mark W. Binder

*Attorney, Agent, or Firm*—Fulwider, Patton, Rieber, Lee & Utecht

[57] ABSTRACT

A drawing table is provided, which has a top hingedly connected at a first end thereof, to a first end of a base, so as to be pivotable between a closed position, and at least one open position with respect to the base. At least one arm, and preferably a pair of arms, are provided, which are movable to an unextended position when the top is in the closed position and in which the arm or arms lies substantially parallel to the top and the base, and one or more extended positions. Each extended position corresponds to an open position of the top. Retaining means preferably of a releasable adhesive material, such as that sold under the trademark VELCRO, releasably retain each arm in each extended position. A flexible reflector sheet is connected to the top and extends between opposite edges of a transparent surface in the top, so that the reflector sheet will lie within the frame when the top is in the closed position, and can curvedly extend beneath the transparent surface when the top is in the open position, thereby reflecting light from a light source through the transparent surface.

21 Claims, 2 Drawing Figures

50
12
16
46
18
30
26
24
34
2
43
20
28
18
36
26
10
31
29
38
32
34
14
31
11
6
28
24
48
38
4
2
10
8

50
45
16
12
50
12
41
20
18
30
26
43
43
24
34
33
32
24
36
31
12
44
42
24
50
14
22
48
6
4
28
29
38
11
43
8

DRAWING TABLE

FIELD OF THE INVENTION

This invention relates to a drawing table particularly useful for drafting or similar purposes.

BACKGROUND OF THE INVENTION

In the field of drafting, it is often necessary to have a translucent flat surface which is illuminated from behind. Such a surface would be used when it is desired to trace drawings, or for other similar purposes. Typically, a drawing table is utilized which has a translucent surface and lights mounted below that translucent surface, which lights are usually fluorescent lights. The translucent surface and the lights are often fixed in position. Such a fixed arrangement is inconvenient since in many cases a draftsman may wish to alter the angle of the translucent surface for comfort and convenience. In many prior art devices which allow the angle of the translucent surface to be adjusted with respect to horizontal, the lights though are fixed in a position for the usually desired intensity of light on the translucent surface, and even distribution of it, only when the translucent surface is at a particular angle. When such angle is altered, as a result of the fixed position of the lights, the intensity of light on the translucent surface may be undesirably decreased or increased, and the even distribution of the light altered.

Devices have been suggested in the past which have attempted to overcome such problems. One such device is disclosed in U.S. Pat. No. 2,328,471 to Leffel. The device as disclosed in that patent is provided with a top which can pivot to varying angles with respect to a base. An elongated light, such as a fluorescent light tube, is disposed in a position spaced underneath a transparent surface (which term is used throughout this application to include translucent surfaces) so as to cause light from the tube to pass through the transparent surface. A reflector of rigid material is then provided which is of a curved shape and disposed beneath the light tube so as to reflect light relatively evenly from it and through the transparent surface such that the transparent surface is relatively evenly illuminated. A difficulty with the foregoing device is that the light tube and rigid reflector must extend at positions considerably far removed from the underside of the transparent surface, if relatively even illumination of the transparent surface is to be obtained. Because of the foregoing rigid construction, when the top is pivoted to a closed position adjacent the base, the device is still bulky in terms of it being fairly thick so that the light tube and reflector are contained within the device.

It is desirable then to have a drawing table with a top which can pivot to an open position with respect to a base, and which has a construction to provide relatively even illumination of a transparent opening in the top, while allowing the top to move to a closed position adjacent the base in which closed position the drawing table is relatively compact particularly in terms of thickness, for convenient transportation and storage.

SUMMARY OF THE INVENTION

A drawing table is provided which comprises a frame having a base, and a top. The top has a transparent surface and a first end hingedly connected to a first end of the base, so that the top can be pivoted between a closed position adjacent the base, and an open position.

The drawing table further comprises an arm connected to the frame and movable to an unextended position when the top is in the closed position, in which situation the arm lies substantially parallel with the top and the base. The arm is also movable to an extended position when the top is in the open position, in which situation the arm extends between positions on the top and the base remote from the respective first ends of them. A retaining means is further provided for releasably retaining the arm in the extended position. Furthermore, a flexible reflector sheet is provided. The flexible reflector sheet is connected to the top and extends between opposite edges of the transparent surface. The foregoing arrangement is so that the reflector sheet will lie within the frame when the top is in the closed position, and can curvedly extend beneath the transparent surface when the top is in the open position.

Preferably the arm is swingable in a plane perpendicular to the first ends of the base and the top. In addition, the flexible reflector sheet also preferably extends in a direction between the first end of the top and an end of the top opposite thereto.

The arm is preferably arranged such that a first end of it is pivotally connected to a side of one of the base and the top, while the retaining means is arranged to releasably retain a second end of the arm adjacent a side of the other one of the base and the top.

A light socket is usefully connected to the arm between the ends of it, so that when a light is received in the light socket, the light extends beneath the transparent surface, and above the reflector sheet when the top is in the open position.

The arm is advantageously arranged to be movable between the unextended position and a plurality of extended positions each corresponding to an open position of the top, and in which of each extended positions the arm extends between positions on the top and base remote from the respective first ends of them. The retaining means in such a construction is for releasably retaining the arm in each of the extended positions, while the flexible reflector sheet can curvedly extend beneath the transparent surface when the top is in any of the open positions.

Advantageously, the drawing table is constructed with two opposed, parallel arms, each of which has a first end pivotally connected to a corresponding side of one of the base and the top, and swingable between an unextended position and a plurality of extended positions in a manner as previously described.

Of the various possible retaining means, preferably the retaining means comprises a releasable adhesive material such as that sold under the trademark VELCRO, positioned so as to releasably retain the second end of each of the arms proximate a corresponding side of the base, when the arms are in any extended position.

Of the various possible shapes of the base in the top, it is preferred that they are rectangular and substantially congruent. Further, the drawing table may usefully additionally comprise an elongated support member which extends between the arms from positions therealong so that the flexible reflector sheet can extend between the light sockets and the support member.

A particularly advantageous construction of the drawing table described, is such that the arms when in the unextended position, have their second ends disposed adjacent the second ends of the top and the base.

DRAWINGS

Embodiments of the invention will now be described in detail with reference to the drawings in which:

FIG. 1 is a perspective view, partially broken away, from above of a drawing table of the present invention; and FIG. 2 is a vertical cross section along the line 2—2 of FIG. 1, showing the top in an open position in solid lines, and in another open position and a closed position in broken lines.

DETAILED DESCRIPTION

Figure 1:
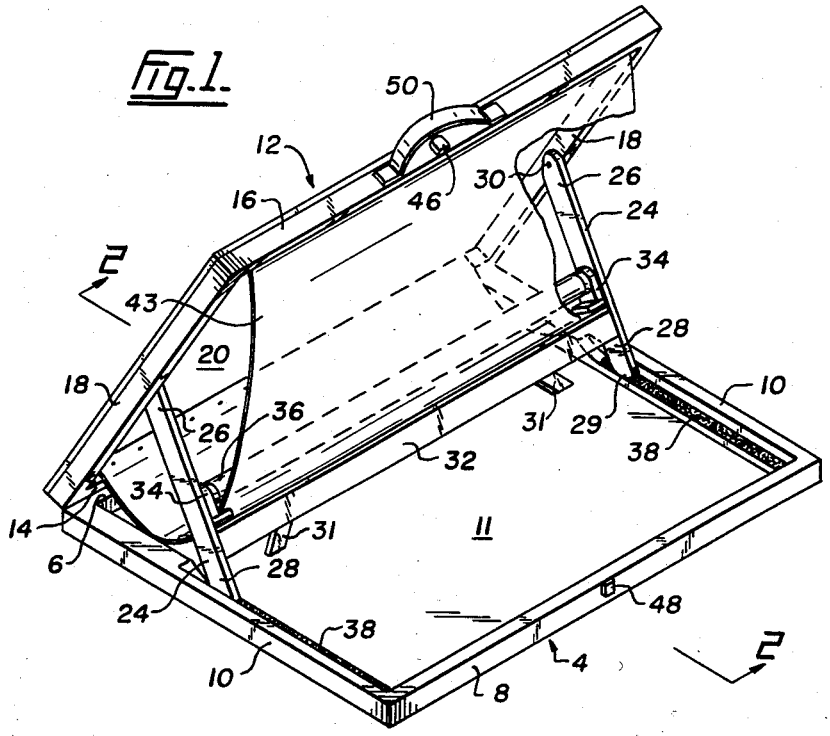

Referring to the drawings, a drawing table is disclosed comprising a frame which consists of a base 4 and a top 12. Base 4 has a first end 6 and opposite end 8, as well as two sides 10, and solid face 11. Base 4 is hingedly connected to a first end 14 of the top 12, by means of hinge 22 extending substantially along the entire length of first end 6 of base 4 and first end 14 of top 12. Top 12 is substantially congruent with base 4, and also has a second end 16 and two opposed sides 18. A transparent surface, consisting of a translucent acrylic sheet 20, such as that sold under the trade mark PLEXIGLAS, extends across an entire upper end of top 12.

Two opposed parallel arms 24 each have a first end 26 connected by means of a pivot pin 30 to an inner surface of a side 18 of top 12. The foregoing arrangement allows each arm 24 to swing in a plane perpendicular to the first end of the top 12 and hinge 22. Each of the arms 24 has a second end 28 and a surface 29 on which is fixed one member of a removable adhesive material such as that sold under the trademark VELCRO. The other member of such material in each case, consists of elongated strips 38 connected adjacent respective sides 10 of base 4. The members 29 and 38 act as retaining means for releasably retaining the second end 28 of each of the arms 24 proximate a corresponding side 10 of the base 4, when the arms 24 are in any extended position, which is a position to retain the top 12 at an angle above base 4.

An elongated support member 32 is provided which extends between the arms 24 from positions therealong between the ends of the arms 24. Support member 32 has a channel extending along its length, from a lower side thereof to a position just short of its top surface. Two pegs 31 are positioned within the channel of member 32 and extend at an angle of about 45° to it, from a position slightly below the top surface of it. A gap 33 between the top end of a peg 31 and the top surface of member 32, is a convenient place at which a knot in an electric cord (not shown) larger than gap 33 may be positioned adjacent thereto, so as to prevent such cord from readily being detached from the drawing table.

Two light sockets 34 are connected to respective arms 24 and support member 32, and are dimensioned to removably receive respective ends of an elongated light tube 36, such as an elongated filament type light tube or fluorescent light tube. A flexible reflector sheet 43 which has an upper surface preferably of a high light reflecting white colour, has ends 44 and 45 connected to an inner surface of first end 14 and second end 16, respectively, of top 12, so that the flexible reflector sheet 43 extends in a direction between the first and second ends. The reflector sheet 43 is sufficiently flexible and of a sufficient length such that it can lie in a stored position within the frame of the drawing table, when the top 12 is in a closed position adjacent the base 8 such as shown in FIG. 2, and can curvedly extend beneath the top 12 when the top 12 is in any open position in which the top 12 is at an angle to base 4, such as the position shown in solid lines in FIG. 2 or the position adjacent thereto shown in broken lines.

The top 12 is provided with a lock section 46 on the second end 16 thereof, while the base 4 is provided with a mating locking section 48 on the second end 8 thereof, the sections 46 and 48 together forming a lock for releasably retaining top 12 in the closed position adjacent base 4 when desired. For convenience of carrying the drawing table when the top 12 is in the closed position, a handle 50 is provided connected to the second end 16 of top 12. When light tube 36 is a fluorescent light tube, a suitable ballast (not shown) is conveniently positioned in the channel in member 32, which channel can along part of its length, be widened for such purpose. In addition, suitable wiring (not shown) between the ballast and fluorescent light tube 36, and a suitable cord and plug for plugging into a standard 110 V outlet are also provided. Such cord can be wrapped around pegs 31 when the drawing table is not in use.

The drawing table described above is for the most part constructed of wood. The inside edges of sides 18, ends 14, and 16, and second end 26 of arms 24 though are preferably covered with a synthetic reflective white material to maximize light reflection. The flexible reflector sheet 43 is preferably constructed of a synthetic material the upper surface of which has high light reflectivity, but which will be sufficiently heat resistant so as not to be affected by warming of fluorescent light tube 36 during operation. If the sockets 34 are constructed to receive a filament type light tube, then appropriate spacer clips (not shown) should be provided adjacent thereto to retain reflector sheet 43 in slightly spaced relation to such tube, since a filament type light tube will generate considerably more heat than fluorescent light tube 36.

Figure 2:
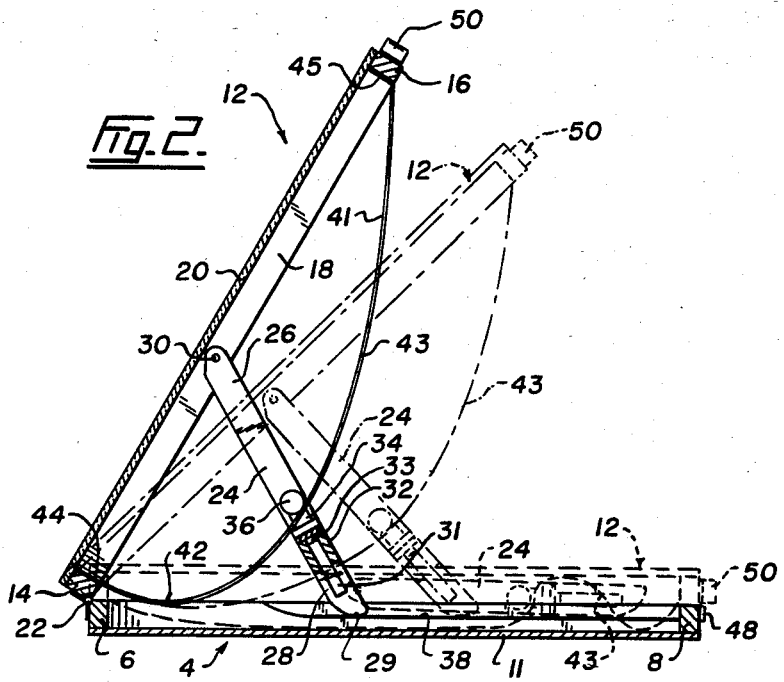

In operation of the drawing table as described, when it is desired to carry or store it, top 12 would be positioned in the closed position as shown in broken lines in FIG. 2. Locking sections 46 and 48 can then be engaged with one another to secure top 12 in the closed position. When it is desired to use the drawing table for tracing or other purposes, top 12 is swung upwardly about hinge 22 to any one of a plurality of open positions such as those shown in broken lines and solid lines in FIG. 2, or in solid lines in FIG. 1. When the top 12 is in the selected open position, arms 24 are swung about their respective pivots to a corresponding extended position in which the VELCRO members 29 engage respective VELCRO strips 38 on base 4. In such a situation then, the second ends 28 of arms 24 are releasably retained proximate respective side 10 of base 4, thereby releasably retaining top 12 in the selected open position. When the arms 24 are in any one of the extended positions, each corresponding to a selected one of the plurality of open positions for the top 12, flexible reflector sheet 43 will curvedly extend beneath the top 12 and light tube 36, in a manner which will assist in reflecting or distributing light from the light tube 36 relatively evenly underneath the transparent light surface 20. Due to the flexible nature of the reflector sheet 43 though, when top 12 is in the closed position, reflector sheet 43 assumes the position shown in broken lines in FIG. 2 thereby allowing the drawing table shown to assume a relatively thin configuration when top 12 is in the closed position.

It will be noted that the greater the opening of top 12 with respect to base 4, the closer will be fluorescent light tube 36 to the lower end of light opening 20. At the same time though, a portion 42 of reflector sheet 43 adjacent the first end 44 thereof, will tend to become more orthogonal to light opening 20, thereby reflecting a greater amount of light from light tube 36 back toward a portion 41 of reflector sheet 43, and hence through a portion of transparent surface 20 adjacent second end 16 of top 12, where light would otherwise be weakest in the absence of such a flexible reflector 43.

It will be evident that in order to change top 12 from one of the plurality of selectable open positions to another such position, or the closed position, the second end 28 of arms 24 are simply forced to swing in a direction toward the second end 8 of base 4, thereby releasing the grip of the VELCRO and allowing top 12 to be placed in any desired position, and arms 24 to be placed in any extended position corresponding to an open position of top 12, or in the unextended position corresponding to the closed position of top 12.

Various modifications to the light table described are of course possible. For example, in construction, one could omit sockets 34 and light tube 36 and appropriate wiring and ballast, but leave everything else the same, in which case it would be understood that the user of such a device could provide his own elongated light in the form of an elongated light tube and a base which can be removably attached to an arm 24 for example, such as by means of one or more spring clips. Other modifications include constructing the device such that when top 12 is in the closed position, second end 28 of arms 24 are disposed adjacent first ends of top 12 and base 4. A disadvantage with the foregoing arrangement is that when such a drawing table is also used to carry drafting papers or other papers, the weight of such papers when the table is being carried, may fall upon light tube 36 and break it. Of course, when the construction is such as is shown in the drawings, light tube 36 will be positioned toward the second end of base 4 and top 12, such that when the drawing table is being carried by handle 50, the weight of documents within the drawing table will not fall upon light tube 36.

As will be apparent to those skilled in the art in light of the foregoing disclosure, many alterations and modifications are possible in the practice of this invention without departing from the spirit or scope thereof. Accordingly, the scope of the invention is to be construed in accordance with the substance defined by the following claims.

I claim:

1. A drawing table comprising:

(a) a frame having:

(i) a base; and (ii) a top with a transparent surface and a first end hingedly connected to a first end of the base, so that the top is pivotable between a closed position adjacent the base, and an open position;

(b) an arm connected to the frame and movable to an unextended position when the top is in the closed position and in which said arm lies substantially parallel to the top and the base, and an extended position when the top is in the open position, and in which said arm extends between positions on the top and base remote from the respective first ends thereof;

(c) retaining means for releasably retaining said arm in the extended position;

(d) a flexible reflector sheet of flexible sheet material connected to the top at two opposite edges of the transparent surface and suspended between said edges, so that said reflector sheet will be in a stored position within the frame when the top is in the closed position, and can move to an extended position spaced away from and curvedly suspended beneath the top when the top is in the open position.

2. A drawing table as described in claim 1 wherein said arm is swingable between the unextended and extended positions, in a plane perpendicular to the first ends of the base and the top, wherein said flexible reflector sheet extends in a direction the first end of the top and an end of the top opposite thereto, and wherein said flexible reflector sheet is pliable so as to move between the stored and extended positions in response to pivoting of the top between the closed and open positions, respectively.

3. A drawing table as described in claim 2 wherein said arm has a first end pivotably connected to a side of one of the base and the top, and wherein said retaining means can releasably retain a second end of said arm adjacent a side of the other one of the base and the top.

4. A drawing table as described in claim 2 additionally comprising a light socket connected to said arm between the ends thereof, so that when a light is received in said light socket the light extends beneath the transparent surface, and above the flexible reflector sheet when the top is in the open position.

5. A drawing table as described in claim 3 additionally comprising a light socket connected to said arm between the ends thereof, so that when a light is received in said light socket the light extends beneath the transparent surface, and above the flexible reflector sheet when the top is in the open position.

6. A drawing table comprising:

(a) a frame having:

(i) a base; and (ii) a top with a transparent surface and a first end hingedly connected to a first end of the base, so that the top is pivotable between a closed position adjacent the base, and a plurality of selectable open positions;

(b) an arm connected to the frame and movable between an unextended position when the top is in the closed position and in which said arm lies substantially parallel to the top and the base, and a plurality of extended positions when the top is in respective open positions, and in which said arm extends between positions on the top and base remote from the respective first ends thereof;

(c) retaining means for releasably retaining said arm in each of the extended positions;

(d) a flexible reflector sheet connected to the top at two opposite edges of the transparent surface and suspended between said opposite edges, so that said reflector sheet will be in a stored position within the frame when the top is in the closed position, and can curvedly suspend to spaced positions beneath the top when the top is in any of the open positions.

7. A drawing table as described in claim 1 wherein said arm is swingable between the unextended and extended positions, in a plane perpendicular to the first ends of the base and the top, wherein said flexible reflector sheet extends in a direction between the first end of the top and an end of the top opposite thereto, and wherein said flexible reflector sheet is pliable so as to move between the stored and extended positions in response to pivoting of the top between the closed and open positions, respectively.

8. A drawing table as described in claim 7 wherein said arm has a first end pivotally connected to a side of one of the base and the top, and wherein said retaining means can releasably retain a second end of said arm adjacent a side of the other one of the base and the top.

9. A drawing table as described in claim 7 additionally comprising a light socket connected to said arm between the ends thereof, so that when a light is received in said light socket the light extends beneath the transparent surface, and above the flexible reflector sheet when the top is in any of the open positions.

10. A drawing table as described in claim 8 additionally comprising a light socket connected to said arm between the ends thereof, so that when a light is received in said light socket the light extends beneath the transparent surface, and above the flexible reflector sheet when the top is in any of the open positions.

11. A drawing table comprising:

(a) a frame having:

(i) a base; and (ii) a top with a transparent surface and a first end hingedly connected to a first end of the base, so that the top is pivotable between a closed position adjacent the base, and a plurality of selectable open positions;

(b) two opposed, parallel arms each having a first end pivotally connected to a corresponding side of one of the base and the top so as to be swingable in a plane perpendicular to the first end thereof, between an unextended position when the top is in the closed position and in which said arms lie substantially parallel to the top and the base, and a plurality of extended positions when the top is in respective open positions and in which a second end of each of said arms is proximate a corresponding side of the other one of the base and the top;

(c) retaining means for releasably retaining said arm in each of the extended positions;

(d) a pliable reflector sheet suspended between and connected to the top at two opposite edges of the transparent surface in a direction between the first end of the top and an end of the top opposite thereto, so that said reflector sheet, in response to pivoting of the top, will move between a stored position, corresponding to the closed position of the top, and in which position said reflector sheet lies within the frame, and extended positions, corresponding to respective open positions of the top, and in each of which positions said reflector sheet curvedly suspends to spaced positions beneath the top.

12. A drawing table as described in claim 11 additionally comprising two light sockets connected to respective arms between the ends thereof, so as to receive an elongated light therebetween which will extend beneath the transparent surface, and above the flexible reflector sheet when the top is in any of the open positions.

13. A drawing table as described in claim 11 wherein the first end of each of said arms is pivotably connected to a corresponding side of the top.

14. A drawing table as described in claim 12 wherein the first end of each of said arms is pivotably connected to a corresponding side of the top.

15. A drawing table as described in claim 13 wherein said retaining means comprises a releasable adhesive material positioned so as to releasably retain the second end of each of said arms proximate a corresponding side of the base when said arms are in any extended position.

16. A drawing table as described in claim 14 wherein said retaining means comprises a releasable adhesive material positioned so as to releasably retain the second end of each of said arms proximate a corresponding side of the base when said arms are in any extended position.

17. A drawing table as described in claim 4 wherein the base and the top are rectangular and substantially congruent.

18. A drawing table as described in claim 10 wherein the base and the top are rectangular and substantially congruent.

19. A drawing table as described in claim 15 wherein the base and the top are rectangular and substantially congruent.

20. A drawing table as described in claim 12 additionally comprising an elongated support member extending between said arms from respective positions therealong so that said flexible reflector sheet can extend between said light sockets and said support member.

21. A drawing table as described in claim 14 wherein said arms when in the unextended position, have their second ends disposed adjacent the second ends of the top and the base.

* * * * *